US007151818B1

(12) United States Patent
Hanington et al.

(10) Patent No.: US 7,151,818 B1
(45) Date of Patent: Dec. 19, 2006

(54) X-RAY TUBE DRIVER USING AM AND FM MODULATION

(76) Inventors: Gary Hanington, P.O. Box 1038, Elko, NV (US) 89803; Mira Kurka, P.O. Box 1038, Elko, NV (US) 89803

( * ) Notice: Subject to any disclaimer, the term of this patent is extended or adjusted under 35 U.S.C. 154(b) by 0 days.

(21) Appl. No.: 11/148,868

(22) Filed: Jun. 8, 2005

(51) Int. Cl.
*H05G 1/12* (2006.01)

(52) U.S. Cl. ..... 378/104; 378/111

(58) Field of Classification Search ..... 378/104–107, 378/111, 119, 138; 363/21, 21.08, 21.02; 315/381, 5.37, 104; 332/121–122
See application file for complete search history.

(56) References Cited

U.S. PATENT DOCUMENTS 4,517,472 A * 5/1985 Ruitberg et al. ..... 307/82

* cited by examiner

*Primary Examiner*—Courtney Thomas
*Assistant Examiner*—Hoon Song

(57) ABSTRACT

Circuit arrangements and methods are disclosed for providing means of driving a grounded anode triode X-Ray tube using one isolation transformer, providing both filament power and controllable grid drive without the need for optical isolation devices. Applications of this design include fast X-Ray imaging such as inspection equipment and systems, which require rapid control of X-Ray intensity. Grounding the anode in X-Ray tube systems is usually done for thermal considerations and therefore requires that the filament and grid to be floating at an extremely large negative potential, usually over 100 kVDC. Isolation transformers are required to provide power to the filament and grid. In this invention, both AM and FM signals are coupled through one isolation transformer. The AM waveform provides controllable power to heat the filament while the FM signal, adjusted in magnitude by a filter arrangement, rectified and smoothed in waveform, provides power for the grid. This design eliminates the need for an additional grid isolation transformer or optical control of the grid element where active circuitry is prone to failure due to tube arcing.

21 Claims, 4 Drawing Sheets

X-RAY TUBE DRIVER USING AM AND FM MODULATION

BACKGROUND OF THE INVENTION—FIELD OF INVENTION

Figure 1:
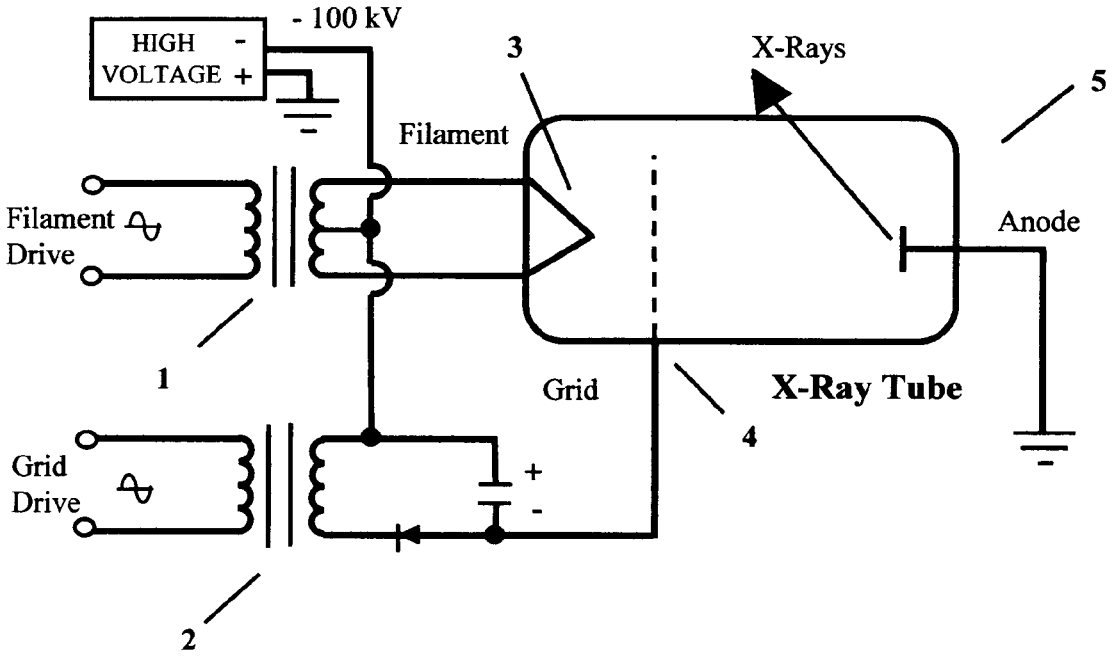
FIG. 1 (Prior Art)

The present invention relates generally to triode controlled X-Ray tubes which operate in the grounded anode mode. More particularly, the present invention relates to a cost-, weight- and volume-effective method for providing a controllable and isolated source of both filament and grid power using one isolation transformer without the additional expense or complexity of an opto-isolation circuit.

BACKGROUND OF THE INVENTION

In 1913, William Coolidge patented the X-Ray tube (U.S. Pat. No. 1,203,495), which was a vast improvement in the art of X-Ray generation. This tube with an active filament as electron emitter is still used today as a source of hard X-Rays for medical and industrial applications. Unfortunately, the intensity of the X-Rays that are emitted from the Coolidge tube are adjusted either by varying the anode to cathode voltage or the temperature of the filament. In most systems it is usually advantageous to control the filament in order to preserve the generation of characteristic K spectrum lines generated by adequate high voltage potentials. Unfortunately, filament control does not lend itself to rapid changes in X-Ray emission due to the thermal time constant of the filament material which is usually measured in seconds. This type of fast response X-Ray producer is needed in computerized X-Ray diagnostic testing where objects such as multi-layer printed circuit boards are rapidly scanned at various degrees of X-Ray intensity. To make a rapid step change in X-Ray intensity requires a rapid step change in filament temperature—a task that is extremely difficult to achieve.

The triode operating X-Ray tube is nearly as old as the Coolidge tube and has had success in being a device where one may change the cathode emission current by varying a negative potential on a electrostatic grid placed close to the filament. By varying the grid between 100 and 1000 volts (negative), most triode X-Ray tubes can be driven from saturation to cutoff with response times on the order of microseconds. Unfortunately, in a grounded anode X-Ray system, the drive circuit is more complex because now in addition to the filament supply, an additional power supply is required to provide grid potential. It must be remembered that both of these power supplies must float at the high voltage applied to the cathode (or the filament in cathodeless tubes) which may be in excess of negative 100,000 volts. This floating effect is usually accomplished by using an isolation transformer which couples energy from a ground referenced point to the filament and grid circuitry which are at a potential of negative 100,000 volts by means of an additional high tension power supply. The dielectric isolation material of the transformer prevents arcing between the primary and secondary which maintains this high voltage potential difference. Isolation transformers are costly and bulky because not only must they prevent arcing between ground and the high voltage potential of the filament and grid circuitry, they also must couple filament and grid power as well.

Shown in FIG. 1 is prior art triode X-Ray system utilizing two isolation transformers. Transformer 1 couples energy for the filament 3. Transformer 2 is used to generate the negative bias required to operate the grid 4 of the X-Ray tube 5. Both supplies provide power to their respective tube elements but, due to the isolation requirements, no feedback signal can be easily sent to provide information on the exact filament or grid voltage values. In many operating systems, there is little need to know the exact grid potential because this voltage is usually enclosed within the feedback loop of the entire system which regulates electron current flowing through the tube. In this type of system the electron emission current flowing from filament to anode is of concern and this parameter can be determined easily by ground referenced measurements. Another prior art design is the optically coupled grid controller shown in FIG. 2. Here, only one isolation transformer 1 is used which generates both power for the filament 2 and an additional voltage for the grid 5 drive by utilizing an additional secondary winding 3 on the transformer 1. In this scheme, some optically controlled amplifying device, in this case three high voltage transistors 4 in series, must be used to adjust for the proper grid 5 voltage of the X-Ray tube 6.

Figure 2:
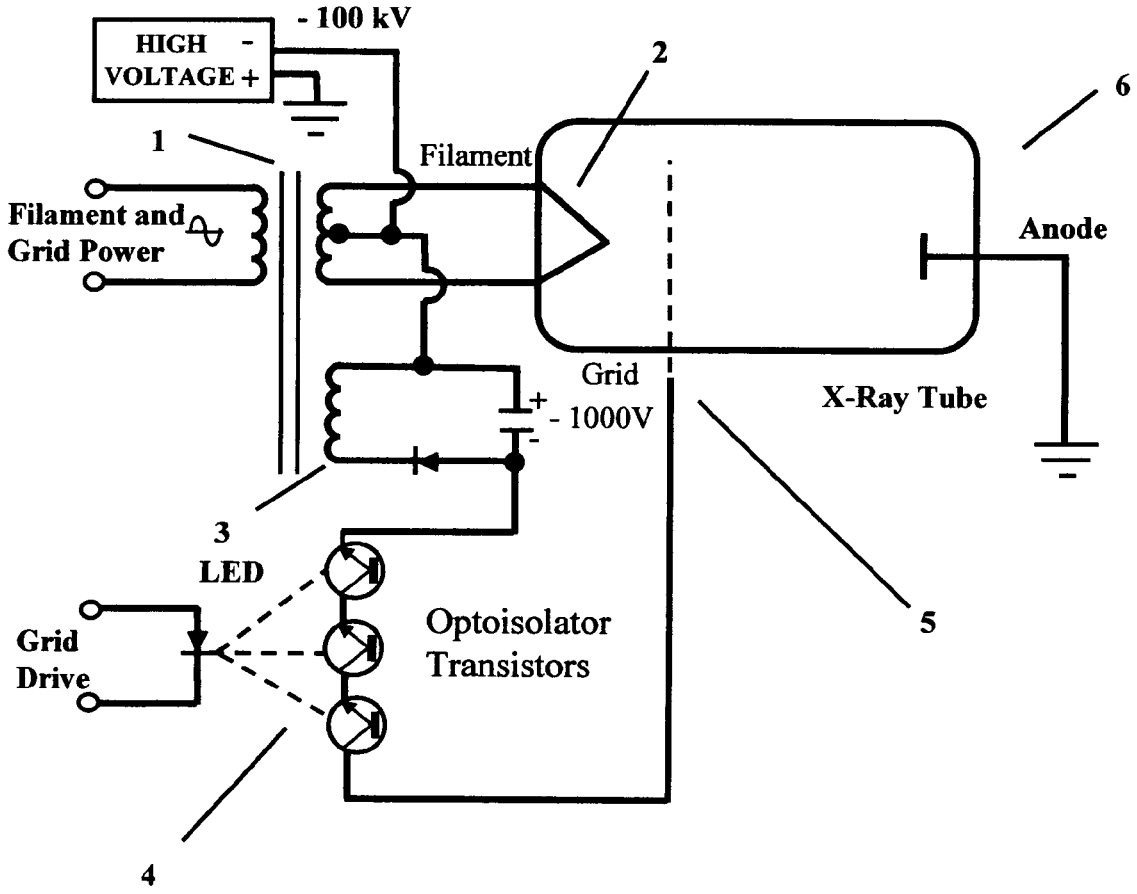
FIG. 2 (Prior Art)

One problem associated with the circuit in FIG. 2 is that an amplifier using active semiconductor devices floating at voltages in excess of 100,000 volts has the likelihood of damage due to the invariable sporadic arcing that occurs within X-Ray tubes. Vacuum arcs are known to display extremely fast rise times which couple energy capacitatively into all controlling circuitry, usually resulting in massive semiconductor failures on the grid drive circuitry. For example, even though the active semiconductor devices 4 in FIG. 2 can be shielded and electrically isolated by resistors from the leads exiting to the X-Ray tube grid element, the active circuitry is still susceptible to failures due to tube arcing. Intense electromagnetic pulses are formed during X-Ray tube arcing which propagate throughout the system, especially in areas connected to tube elements such as the grid element. Because of this action it is inherently more advantageous to limit active semiconductor usage in these areas. Although all semiconductor devices are prey to the effects of tube arcing, it has been found that PN junction diodes are definitely less susceptible to high voltage pulses than active devices such as transistors.

As will be described in the following detailed description, the present invention overcomes many of the cost, size; weight and reliability problems associated with prior art triode X-Ray tube filament and grid drivers by utilizing only one isolation transformer and effectively sending two different power signals through it. Eliminating the transistors in the optically controlled grid supply eliminates the failure prone active circuitry and increases system reliability. Using only one isolation transformer to send both the filament and grid control power through is beneficial from a cost savings and volumetric efficiency consideration as well.

BACKGROUND OF INVENTION—OBJECTS AND ADVANTAGES

The invention that will be described in the following paragraphs has several advantages over prior art. First, this topology allows the use of only one isolation transformer without the need of an optically coupling device to control grid output voltage. Secondly, the use of a simple grid voltage generation circuitry limits the failure modes that can occur in active semiconductor circuitry floating at 100,000 volts. Thirdly, by removing the optical controller, the effect of component aging of optical detectors is eliminated and the ability to control the closed loop emission current feedback system is made simpler. This is understood because the semiconductor induced non-linearity of the optical control method has been replaced with a simple circuit which generates grid voltage from an FM signal sent through the single isolation transformer. In addition, by selecting the proper range of frequency to voltage conversion ratio, the X-Ray tube may be operated from full saturation to cutoff. Finally, by selecting the proper direction of frequency change to voltage generation profile—that is, decreasing the grid potential (increasing emission current) as the controlling frequency is increased—a degenerative feedback is designed in, allowing easier loop stabilization.

SUMMARY

Circuit arrangements and methods are disclosed for the design of an isolated output filament and grid driver which powers a grounded anode triode X-Ray tube. In this design, one isolation transformer serves to bring power to the filament and at the same time allows controllability of the grid voltage. This is accomplished by utilizing an AM signal for the filament drive and an FM signal for the grid voltage drive. By utilizing a simple resonant filtering system, allowing varying signals to drive a rectifier, the grid supply section can be designed to run the X-Ray tube from cutoff to complete saturation. In other words, the isolation transformer is driven with a periodic oscillatory voltage variable in both amplitude and frequency. By adjustment of the amplitude of this oscillatory waveform the temperature of the filament is adjusted in the X-Ray tube. Moreover, by adjustment of the frequency of this oscillatory waveform and passing this signal through a simple resonant filter coupled to a rectifier stage, an adjustable grid potential is achieved. When the frequency of the periodic oscillatory waveform is adjusted to vary the grid voltage, the heating of the filament remains relatively constant because the RMS voltage of the waveform is not affected by frequency. By using this topology, the grid voltage may be adjusted in excess of a 1:10 range depending on the sharpness of the resonant filter in the grid circuitry. In the present invention, the use of only one isolation transformer to perform two widely different functions reduces size, weight, and cost and increases system reliability because fewer parts are used for the same performance than in prior art systems.

DRAWINGS—FIGURES

FIG. 1: Illustrates prior art arrangement of a triode X-Ray tube being driven by two isolation transformers.

FIG. 2: Illustrates a prior art arrangement of a triode X-Ray tube being driven by a single isolation transformer with optical grid control.

Figure 3:
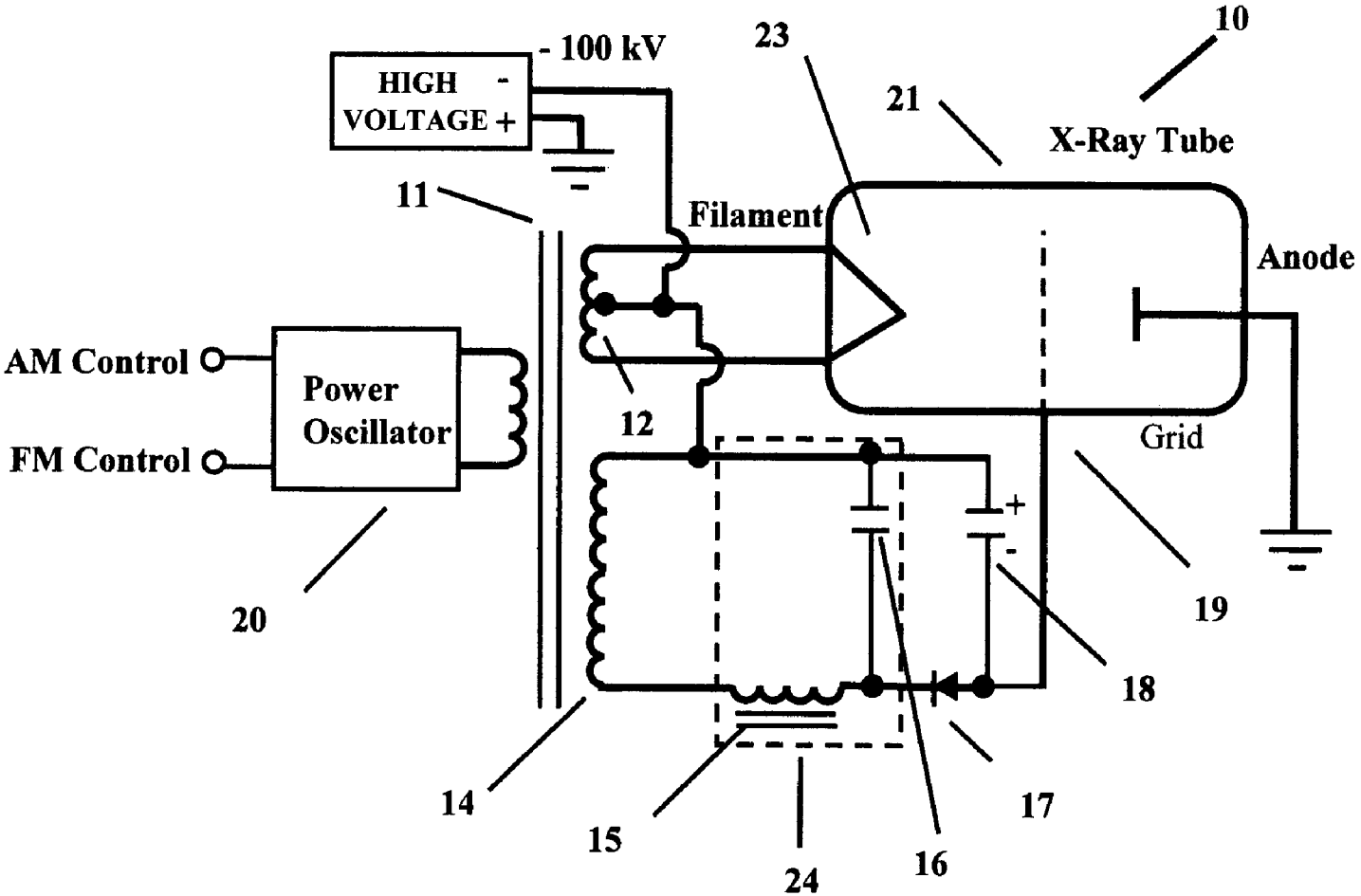

FIG. 3: Illustrates the present invention using AM and FM techniques to provide both filament and grid control for the triode X-Ray tube.

Figure 4:
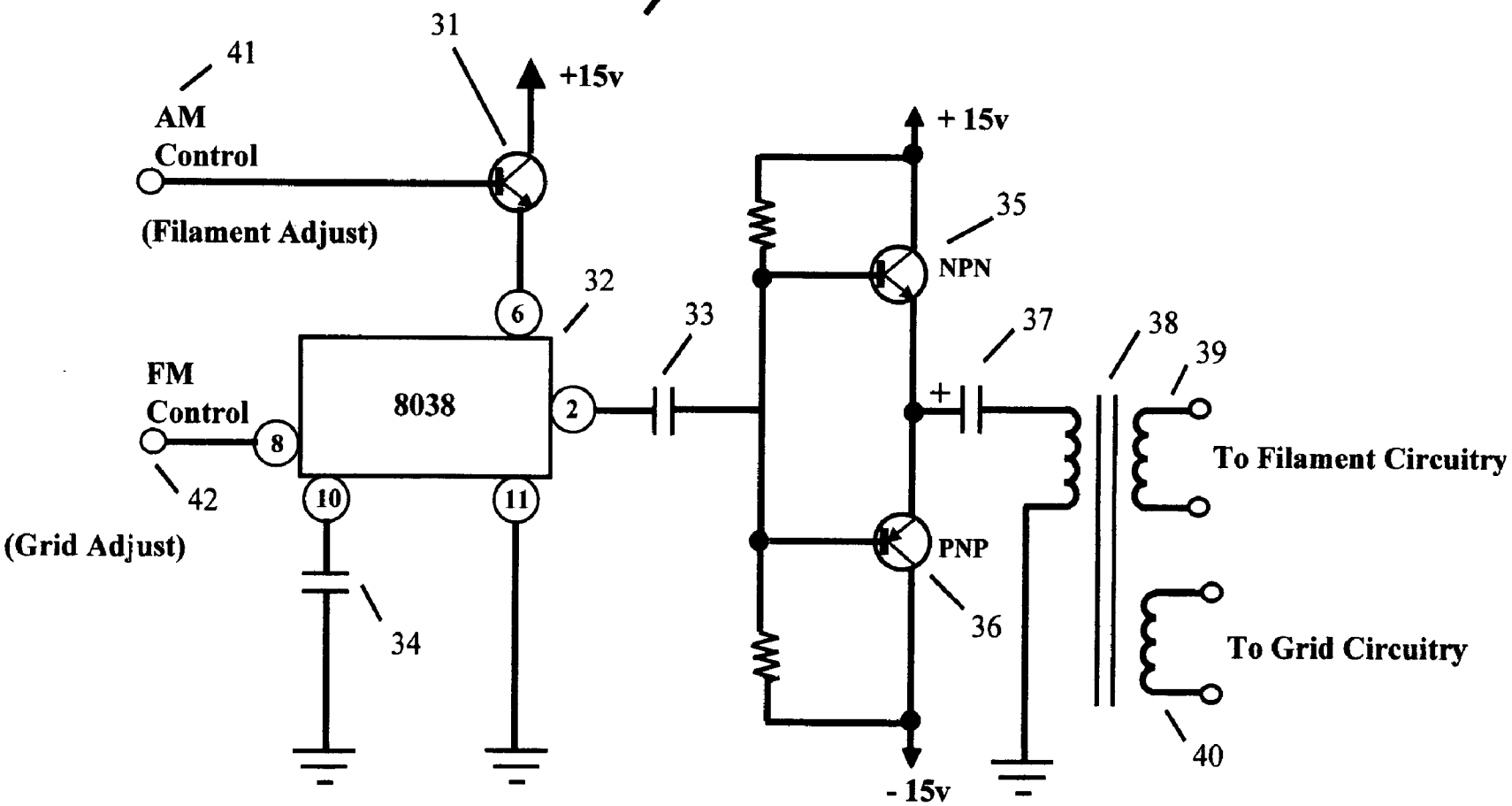

FIG. 4: Illustrates one embodiment of the AM/FM controlled power oscillator.

DETAILED DESCRIPTION—FIGS. 3–4

The present invention discloses circuit arrangements and methods for construction of a triode X-Ray tube isolated filament and grid driver using AM and FM modulation purposes of explanation, specific numbers, times, frequencies, dimensions, waveforms, and configurations are set forth in order to provide a through understanding of the present invention. However, it will be apparent to one skilled in the art that the present invention may be practiced without these specific details.

In FIG. 3, the filament and grid drive circuitry is shown in arrangement 10 according to the present invention. This X-Ray tube filament and grid driver is shown as disposed within an X-Ray machine (not shown), for example and without limitation an X-Ray imaging system. As shown in FIG. 3, the arrangement 10 consists of several essential subsections which drive and control the X-Ray tube with some components of the prior art arrangement shown in FIGS. 1 and 2. However, the arrangement of 10 of isolation transformers and lack of an optically controlled circuit for the grid drive section. In particular, the operation of the isolation transformer 11, a laminated iron or ferrite device, is coupled in such a manner so as to be driven by a periodic oscillatory waveform produced by a power oscillator 20, providing both a variable amplitude and variable frequency signal controlled by some electronic means. It is understood that the power oscillator 20 is controlled by reference signals so as to eventually control the filament 12 temperature and grid 19 potential.

In FIG. 3, arrangement 10 shows a power oscillator block. In the presently practiced embodiment, the amplitude of the oscillator is varied between 5 and 15 V peak to peak and the frequency is varied between 5 and 20 kHz. This is accomplished by utilization of an 8038 sine wave generator integrated circuit as shown in FIG. 4. The signal from the 8038 integrated circuit is generated by means of a timing capacitor 34 and various resistors (not shown) and is coupled to a power amplifier stage through a coupling capacitor 33. From this point, a class B complementary—symmetry output stage comprised of an NPN 35 and PNP 36 semiconductor device provides power to drive the isolation transformer 38 through a coupling capacitor 37. In FIG. 4, the filament secondary of the isolation transformer 39 is coupled to the filament of the X-Ray tube (not shown) and the grid drive secondary 40 is coupled to the grid drive circuitry (not shown). While this presently practiced embodiment provides the required signals and power to the isolation transformer primary, it is only one of many techniques that can be used to provide the required waveforms to drive the isolation transformer. Any suitable oscillator whose amplitude and frequency can be varied coupled to an amplification power stage will suffice in comprising the power oscillator section 30 of this invention. The frequency of the 8038 output is varied by adjustment of the frequency control 42 and adjustment of the voltage applied to the integrated circuit through an emitter follower transistor 31 by adjustment of base potential from an AM control signal 41. For clarity, many additional components which are required for waveform symmetry are not shown, it is understood that one skilled in this art will be able to understand the basic operating principles involved.

Referring again to FIG. 3, the output of this power oscillator 20 drives the primary of an isolation transformer 11 where an isolation capability between input and output is sufficient to prevent dielectric breakdown between the primary and secondary of the device. As mentioned earlier, this value may exceed 100 kilovolts in certain designs. The secondary winding of this transformer 11 is split into two different sections. One secondary 12 directly drives the filament 23 of the X-Ray tube. Since most tubes require a low voltage (less than 12 volts AC) to drive their filament, it is understood that this winding would have a limited number of turns. In addition, although not necessary, to prevent the AC filament drive waveform from affecting emission current, the grid and high voltage supplies are referenced to the center tap of this winding 12. By varying the amplitude of the periodic oscillatory waveform, the filament temperature of the X-Ray tube may be controlled from less than 30% to full emission temperature.

The other secondary winding 14 of the isolation transformer has a larger number of turns because it powers the higher voltage grid circuitry. Here, the output of this secondary 14 is coupled into a series resonant filter, composed of filter inductor 15 and capacitor 16 which provides attenuation to the periodic oscillatory waveform as a function of frequency. The output of this filter arrangement is coupled to a rectifier 17 which converts the AC waveform to DC. This DC voltage is filtered by smoothing capacitor 18. The voltage generated by this section is coupled to the grid 19 of the X-Ray tube 21. In one presently practiced embodiment, the design is such that a grid voltage of −1,000 volts DC is obtained when the driving periodic frequency is 5,000 kHz, and lowers to less that—100 volts (all with respect to the filament winding 12 center tap) as the driving frequency is raised upwards towards 20 kHz. In this manner the triode X-Ray tube 21 may be driven from cutoff to full saturation.

In the present invention, it is anticipated that the transformer 11 comprises a high frequency laminated iron transformer which can couple the periodic oscillatory signals to the filament and the grid drive circuitry with a minimum amount of distortion or loss. Transformer 11 may also be constructed utilizing a ferrite core material providing that the driving frequency is not allowed to go below the level where saturation of the ferrite cores will result. It is understood that other types of rectification and filtering may be employed on the output of the grid drive circuitry, for example half wave rectifiers and other embodiments utilizing a center tapped transformer secondary. In addition, another embodiment of this invention may utilize a DC driven filament by a rectification stage interspaced between the isolation transformer and the X-Ray tube filament.

The minimum operating frequency of the driver is set to a frequency higher than the resonant frequency of the series resonant filter circuit 24, as determined by the values of resonant filter elements, inductor 15 and capacitor 16. Now, as the frequency of the power oscillator is increased, the generated DC grid voltage decreases because less signal is admitted through the filter 24. This lowering of grid potential allows more cathode current in the X-Ray tube to flow. The selection of operating on the upper frequency side of the resonant filter curve, provides a slight beneficial degenerative effect on the control of the tube. This occurs because higher frequencies produce slightly less filament drive due to the inherent leakage inductance in the isolation transformer and the inductance of the filament itself Due to this effect, when the user attempts to drive the tube harder by increasing the frequency, the filament temperature is slightly lowered cutting back electron emission. This negative feedback increases the stability of the controlling emission current feedback loop. It is obvious that in some X-Ray tube systems this negative feedback effect may not be needed due to limited tube gain. In this case, this invention may be operated on the lower frequency side of the resonant filter circuit, where decreasing the frequency will lower the grid potential, increasing filament electron emission and X-Ray intensity.

For X-Ray tubes which have relatively large gains, it is conceivable that only one secondary winding may be needed and the resonant filter arrangement be connected directly to the filament driver winding.

We claim:

1. A triode x-ray tube isolated filament and grid driver comprising:

a) an amplitude modulated and frequency modulated controllable power oscillator comprising a circuitry composed of integrated circuits to produce controllable AM and FM periodic oscillatory waveforms, b) a voltage transforming means with high voltage isolation coupled to said power oscillator, c) a resonant tuned circuit means coupled to said voltage transforming means, d) a rectification means coupled to said resonant tuned circuit means, e) a filtering means coupled to said rectification means, whereby said x-ray tube is configured to be varied rapidly in emission intensity.

2. The triode x-ray tube isolated filament and grid driver of claim 1 wherein the voltage transforming means comprises an isolation transformer coupling the periodic oscillatory electronic waveform produced by said power oscillator to the X-Ray tube filament and grid control circuitry, said voltage transforming means magnetic core selected from the group consisting of iron laminations and ferrite magnetic materials.

3. The triode x-ray tube isolated filament and grid driver of claim 1 further comprising a secondary low voltage filament driver winding comprising turns on a core of the voltage transforming means.

4. The triode x-ray tube isolated filament and grid driver of claim 1 further comprising a secondary grid power winding comprising turns on a core of the voltage transforming means.

5. The triode x-ray tube isolated filament and grid driver of claim 1 further comprising a secondary low voltage filament driver winding coupled to the x-ray tube filament.

6. The triode x-ray tube isolated filament and grid driver of claim 1 further comprising a secondary grid power winding coupled to the resonant tuned circuit means, the resonant tuned circuit means comprising a passive or active filter means tuned to a frequency within the bandwidth of the said power amplitude and frequency modulated controllable oscillator.

7. The triode x-ray tube isolated filament and grid driver of claim 1 wherein the rectification means is coupled to the resonant tuned circuit means, converting AC waveforms to DC.

8. The triode x-ray tube isolated filament and grid driver of claim 1 wherein the filtering means comprises a capacitor or other charge storage device and reduces ripple on the DC grid voltage.

9. An x-ray tube filament and grid driver comprising:

a) an electronic oscillator with adjustable amplitude and frequency output, b) an isolation transformer with one or more secondary windings, c) a frequency selective device for attenuating grid driver waveforms, d) a grid voltage rectification means, e) a grid voltage filtering means, whereby an x-ray tube is controlled using one isolation transformer passing both AM and FM signals.

10. The x-ray tube filament and grid driver of claim 9, said electronic oscillator producing a selected range of oscillatory periodic waveforms variable and controllable in amplitude and frequency.

11. The x-ray tube filament and grid driver of claim 9, wherein the isolation transformer is driven from said electronic oscillator with both AM and FM signals.

12. The x-ray tube filament and grid driver of claim 9, further comprising a filament and filament circuitry, wherein said AM signal from said isolation transformer is coupled to the filament circuitry, causing said filament to operate with continuously variable power levels.

13. The x-ray tube filament and grid driver of claim 9, wherein said FM signal from said isolation transformer is coupled to said frequency selective device, causing periodic oscillatory waveforms to vary continuously in magnitude.

14. The x-ray tube filament and grid driver of claim 9, further comprising an x-ray tube filament, said isolation transformer providing electrical power to said x-ray tube filament, said electrical power varying in magnitude as a function of an amplitude modulated signal produced by said electronic oscillator.

15. The x-ray tube filament and grid driver of claim 9, said frequency selective device for attenuating grid driver waveforms coupled to said isolation transformer.

16. The x-ray tube filament and grid driver of claim 9, said frequency selective device for attenuating grid driver waveforms coupled to said grid voltage rectification means, said grid voltage rectification means converting said attenuated waveform into DC waveform.

17. The x-ray tube filament and grid driver of claim 9, said frequency selective device for attenuating grid driver waveforms comprising an inductive and capacitive element adjusted in values to form a resonant point operative within the bandwidth of said isolation transformer.

18. A grounded anode triode x-ray tube filament and grid driver comprising:

a) an oscillator with controllable amplitude and frequency output, said oscillator configured to drive a primary winding of an isolation transformer without distortion, b) an isolation transformer coupled to said oscillator, c) a secondary winding on said isolation transformer providing filament power to an X-Ray tube, d) resonant filter circuitry coupled to said secondary winding and providing grid control power driving grid control circuitry, e) a frequency controlled attenuation means coupled to said secondary winding and causing a secondary waveform to be adjustable as a function of oscillator frequency, whereby an x-ray tube is operated from saturation to cutoff with speed of emission adjustment greater than that obtained by just filament control alone without the use of optical electronic components.

19. A method of operating the grounded anode triode x-ray tube filament and grid driver of claim 18 comprising utilizing degenerative feedback by operating FM grid control signals in the range of frequencies above the resonant point of said resonant filter circuitry.

20. A method of operating the grounded anode triode x-ray tube filament and grid driver of claim 18 comprising operating FM grid control signals in the range of frequencies below the resonant point of said resonant filter circuitry for tubes with low gain where stability is not an issue.

21. A method of operating the grounded anode triode x-ray tube filament and grid driver of claim 18 comprising utilizing said secondary winding to provide both filament power and grid drive power in tube systems which require grid control voltages in the order of the magnitude of the filament voltage.

* * * * *